US011839265B2

(12) United States Patent
So

(10) Patent No.: US 11,839,265 B2
(45) Date of Patent: Dec. 12, 2023

(54) DETACHABLE LACING APPARATUS USING SHOELACE LOOP FOR FOOTWEAR

(71) Applicant: WINDWIRE CO. LTD., Seongnam-si (KR)

(72) Inventor: Youn-Seo So, Hwaseong-si (KR)

(73) Assignee: WINDWIRE CO. LTD., Seongnam-si (KR)

( * ) Notice: Subject to any disclaimer, the term of this patent is extended or adjusted under 35 U.S.C. 154(b) by 228 days.

(21) Appl. No.: 17/527,258

(22) Filed: Nov. 16, 2021

(65) Prior Publication Data

US 2023/0097542 A1 Mar. 30, 2023

(30) Foreign Application Priority Data

Sep. 29, 2021 (KR) ..... 10-2021-0129051

(51) Int. Cl.
*A43C 11/16* (2006.01)

(52) U.S. Cl.
CPC ..... *A43C 11/165* (2013.01)

(58) Field of Classification Search
CPC ..... A43C 11/16; A43C 11/164
See application file for complete search history.

(56) References Cited

U.S. PATENT DOCUMENTS 5,477,593 A * 12/1995 Leick ..... A43C 7/00 24/712.1
7,516,914 B2 * 4/2009 Kovacevich ..... A43C 11/165 242/395
9,918,516 B1 * 3/2018 Hall ..... A43C 11/008
10,772,384 B2 * 9/2020 Whewell ..... A43B 1/0081
10,842,230 B2 * 11/2020 Pollack ..... A43C 7/00
11,129,447 B2 * 9/2021 Dyer ..... A43C 1/06
11,357,279 B2 * 6/2022 Cotterman ..... A42B 3/064
2004/0221433 A1 * 11/2004 Wolfberg ..... A43B 3/0078 24/712.5
2007/0169378 A1 * 7/2007 Sodeberg ..... A45C 7/0063 36/50.5
2009/0172928 A1 * 7/2009 Messmer ..... A43C 7/00 242/407.1
2012/0005865 A1 * 1/2012 Boden ..... F16G 11/101 24/136 R
2015/0076272 A1 * 3/2015 Trudel ..... A43C 11/165 242/381.4
2016/0058130 A1 * 3/2016 Boney ..... A43B 3/36 24/712.6

FOREIGN PATENT DOCUMENTS

KR 100959800 5/2010
KR 10-1107372 1/2012
KR 10-1147681 5/2012

* cited by examiner

*Primary Examiner* — Bao-Thieu L Nguyen
(74) *Attorney, Agent, or Firm* — LEX IP MEISTER, PLLC

(57) ABSTRACT

Proposed is a detachable lacing apparatus using a shoelace loop for footwear and, more particularly, to a detachable lacing apparatus using a shoelace loop for footwear, the apparatus including a shoelace length adjuster that is provided with, on one side thereof, a length adjuster detachable part on which a locking groove part is formed, wherein in the locking groove part, a shoelace loop passed through a shoelace hole is fastened to be tightened and untightened according to winding and unwinding of the length adjuster, so that the shoelace length adjuster that a user desires may be customized and easily attached to the user's shoes.

4 Claims, 6 Drawing Sheets

DETACHABLE LACING APPARATUS USING SHOELACE LOOP FOR FOOTWEAR

CROSS REFERENCE TO RELATED APPLICATION

The present application claims priority to Korean Patent Application No. 10-2021-0129051, filed Sep. 29, 2021, the entire contents of which is incorporated herein for all purposes by this reference.

BACKGROUND OF THE INVENTION

Field of the Invention

The present disclosure relates to a detachable lacing apparatus using a shoelace loop for footwear and, more particularly, to a detachable lacing apparatus using a shoelace loop for footwear, the apparatus including a shoelace length adjuster that is provided with, on one side thereof, a length adjuster detachable part on which a locking groove part is formed, wherein in the locking groove part, a shoelace loop passed through a shoelace hole is fastened to be tightened and untightened according to winding and unwinding of the length adjuster, so that the shoelace length adjuster that a user desires may be customized and easily attached to the user's shoes.

Description of the Related Art

Shoes, such as sneakers, are provided with shoelaces so that the shoes fit each individual's feet well. After putting on shoes, the wearer pulls and tightens the shoelaces appropriately so that their feet and shoes are in close contact, enabling safe and comfortable walking.

However, it is very cumbersome to loosen or re-tighten shoelaces every time shoes are put on and taken off, and for that reason, a number of shoelace length adjusting devices have been developed and proposed to solve this inconvenience.

Korean Patent No. 10-0959800 (Published May 28, 2010) discloses a string length adjustment device, which includes: a fixed housing; a rotation housing rotatably coupled to the fixed housing; a winding drum disposed in the fixed and rotation housings and in which a string is wound or unwound; the first sawteeth and the second sawteeth disposed on one side of one of the fixed and rotation housings and provided along the direction in which the fixed and rotation housings are coupled to each other; a latch disposed in the other housing where the first sawteeth and the second sawteeth are not provided and interlocking and interacting with the first sawteeth and the second sawteeth so that the string on the winding drum can be wound or unwound; at least one guide protrusion disposed to protrude upward from the upper portion of the winding drum; a protrusion guide part formed in the rotation housing and in which the guide protrusion is accommodated and guided; a free-form spring coupled to the upper portion of the rotation housing; and a coupling member for coupling the fixed and rotation housings so that the latch selectively interlocks with any one of the first sawteeth and second sawteeth.

Korean Patent No. 10-1147681 (Published May 22, 2012) discloses a string length adjustment device, which includes: a fixed housing; a rotation housing rotatably coupled to the fixed housing; a winding drum inserted into the fixed housing and the rotation housing; a coupling unit coupling the fixed housing and the rotation housing; and a free-form spring coupled to the upper portion of the rotation housing, and wherein the first sawteeth and the second sawteeth are formed on one side of one of the fixed housing and the rotation housing, a latch selectively interlocking and interacting with the first sawteeth and the second sawteeth is provided in the other housing where the first sawteeth and the second sawteeth are not formed, and in the lower region of the rotation housing and the upper region of the winding drum, the housing coupling sawteeth and the drum coupling sawteeth, which act while interlocking with each other, are provided in the form of forming a circle, respectively.

Korean Patent No. 10-1107372 (Published Jan. 19, 2012) discloses a string length adjustment device, which includes: a fixed housing including a drum rotation shaft formed in a central region thereof; a rotation housing rotatably coupled to the fixed housing; a winding drum inserted into the fixed housing and the rotation housing, and including a winding part around/from which a string is wound or unwound; and a coupling unit guide shaft coupling the fixed housing and the rotation housing, and guiding up and down operations of the rotation housing for operations of winding or unwinding the string.

However, it is common that the shoelace length adjusting devices as described above are provided by being integrally attached to a shoe in the manufacturing stage of manufacturing shoes such as sneakers.

Therefore, there is a limitation that such a shoelace length adjusting device cannot be applied afterwards to shoes manufactured without a shoelace length adjusting device attached in the first place, namely, shoes such as ready-made sneakers that are basically manufactured and sold only with shoelaces.

Documents of Related Art

Patent Documents

Korean Patent No. 10-0959800 (Title: APPARATUS FOR ADJUSTING LENGTH OF A LINE)
Korean Patent No. 10-1147681 (Title: APPARATUS FOR ADJUSTING LENGTH OF LACE)
Korean Patent No. 10-1107372 (Title: APPARATUS FOR ADJUSTING LENGTH OF LACE)

SUMMARY OF THE INVENTION

Accordingly, the present disclosure has been made keeping in mind the above problems occurring in the related art, and an objective of the present disclosure is to provide a detachable lacing apparatus using a shoelace loop for footwear, the apparatus including a shoelace length adjuster provided with, on one side thereof, a length adjuster detachable part on which a locking groove part is formed, wherein in the locking groove part, a shoelace loop passed through a shoelace hole is fastened to be tightened and untightened according to winding and unwinding of the length adjuster, so that the shoelace length adjuster that a user desires may be customized and easily attached to the user's shoes, making the shoelace length adjuster easier to loosen or tighten shoelaces.

Another objective of the present disclosure is to provide a detachable lacing apparatus using a shoelace loop for footwear, the apparatus including a shoelace length adjuster provided with, on one side thereof, a length adjuster detachable part on which two locking groove parts are formed, wherein in the locking groove part, two shoelace loops passed through adjacent two shoelace holes are fastened to be tightened and untightened according to winding and unwinding of the length adjuster, so that the shoelace length adjuster having a cylindrical shape is easily fixed and attached to the shoe in a way that attaches closely and firmly to the shoe, thus making the shoelace length adjuster more stable and easier to loosen or tighten shoelaces.

Yet another objective of the present disclosure is to provide a detachable lacing apparatus using a shoelace loop for footwear, the apparatus including a shoelace length adjuster provided further with a cylindrical-shaped detachable housing having separately a shoelace loop bifurcation part in which each shoelace loop in two lines fastened in two opposing locking grooves passes from the upper side to the lower side of a shoe upper through adjacent two shoelace holes and branches into two first and second lines respectively, thus the two first lines are interconnected together and the two second lines are separated from each other and commonly connected to a winding drum, so that the shoelace length adjuster is attached firmly to the shoe and can be easily attached to and detached from the shoe, thus making the shoelace length adjuster more stable and easier to loosen or tighten the shoelace.

In order to achieve the above objectives, according to an embodiment of the present disclosure, there is provided a detachable lacing apparatus using a shoelace loop for footwear, the apparatus including a shoelace having ends parts connected to each other after being passed through a plurality of shoelace holes or shoe eyelets formed on a shoe; and a shoelace length adjuster in which the shoelace is wound and connected, and configured to tighten the shoelace by rotation, wherein the shoelace length adjuster is fixed by a shoelace loop passed through the shoelace holes or the shoe eyelets.

The shoelace length adjuster further includes a length adjuster detachable part to which the shoelace loop is fixed, wherein the length adjuster detachable part is provided with a locking groove part in which the shoelace loop is fastened.

In addition, the locking groove part is formed in two sections facing each other on an upper side of the length adjuster detachable part so as to allow two shoelace loops passed through adjacent two shoelace holes to be oppositely fastened thereto.

In addition, the shoelace length adjuster further includes a detachable housing having therein a cylindrical-shaped accommodation part, of which an upper portion is open, wherein the length adjuster detachable part is formed by protruding from one side of the detachable housing.

In addition, the shoelace length adjuster includes a fixed housing seated and fixed in the accommodation part of the detachable housing and having a vertical opening; a winding drum arranged in the opening and having a winding part configured to allow the shoelace to be wound or unwound therearound or therefrom; and a rotation housing configured to be rotatable with respect to the fixed housing and coupled thereto to be vertically movable in an axial direction with the winding drum as an axis while rotating the winding drum.

In addition, the length adjuster detachable part is located, when the shoelace length adjuster is attached, between the adjacent two shoelace holes through which the two shoelace loops pass.

In addition, the detachable housing includes: a shoelace loop bifurcation part formed on a lower side of the detachable housing and in which each shoelace loop in two lines fastened in two opposing locking grooves passes through a shoe upper through the adjacent two shoelace holes and branches into two first and second lines respectively so that the two first lines are interconnected and the two second lines are separated and connected to the winding drum; and a shoelace passing hole formed in a central portion adjacent to the shoelace loop bifurcation part, and through which two second lines branched from the shoelace loop bifurcation part pass and are connected to the winding drum.

In addition, the shoelace loop bifurcation part includes: two shoelace loop passing holes opposite to each other for allowing the two shoelace loops, passed through a shoe upper through the adjacent two shoelace holes, to pass therethrough while facing each other and to branch into the first and second lines; and a shoelace loop connecting groove formed between the two shoelace loop passing holes opposite to each other and through which the two first lines are interconnected together, and wherein the two second lines are separated from each other through the two shoelace loop passing holes and connected to the winding part of the winding drum through the shoelace passing hole.

In addition, the two second lines connected to the winding drum are separated facing each other in the winding part to be wound or unwound.

According to an aspect of the present disclosure, a detachable lacing apparatus using a shoelace loop for footwear configured as above is provided with a length adjuster detachable part on which a locking groove part is formed, wherein in the locking groove part a shoelace loop passed through a shoelace hole, a shoe eyelet, or a shoe tongue is fastened to be tightened and untightened according to winding and unwinding of the shoelace length adjuster, so that the shoelace length adjuster that a user desires can be customized and easily attached to the user's shoes, making the shoelace length adjuster easier to loosen or tighten shoelaces.

Also, on one side of the shoelace length adjuster, the length adjuster detachable part is provided, on which two locking groove parts are formed, wherein in the locking groove part, two shoelace loops passed through adjacent two shoelace holes are fastened to be tightened and untightened according to winding and unwinding of the shoelace length adjuster so that the shoelace length adjuster having a cylindrical shape can be easily fixed and attached to the shoe in a way that sticks closely and firmly to the shoe, thus making the shoelace length adjuster more stable and easier to loosen or tighten shoelaces.

Also, the shoelace length adjuster is provided further with a cylindrical-shaped detachable housing having separately a shoelace loop bifurcation part in which each shoelace loop in two lines fastened in two opposing locking grooves passes from the upper side to the lower side of a shoe upper through the adjacent two shoelace holes and branches into two first and second lines respectively, thus the two first lines are interconnected together and the two second lines are separated from each other and commonly connected to a winding drum, so that the shoelace length adjuster can be attached firmly to the shoe, thus making the shoelace length adjuster more stable and easier to loosen or tighten the shoelace.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
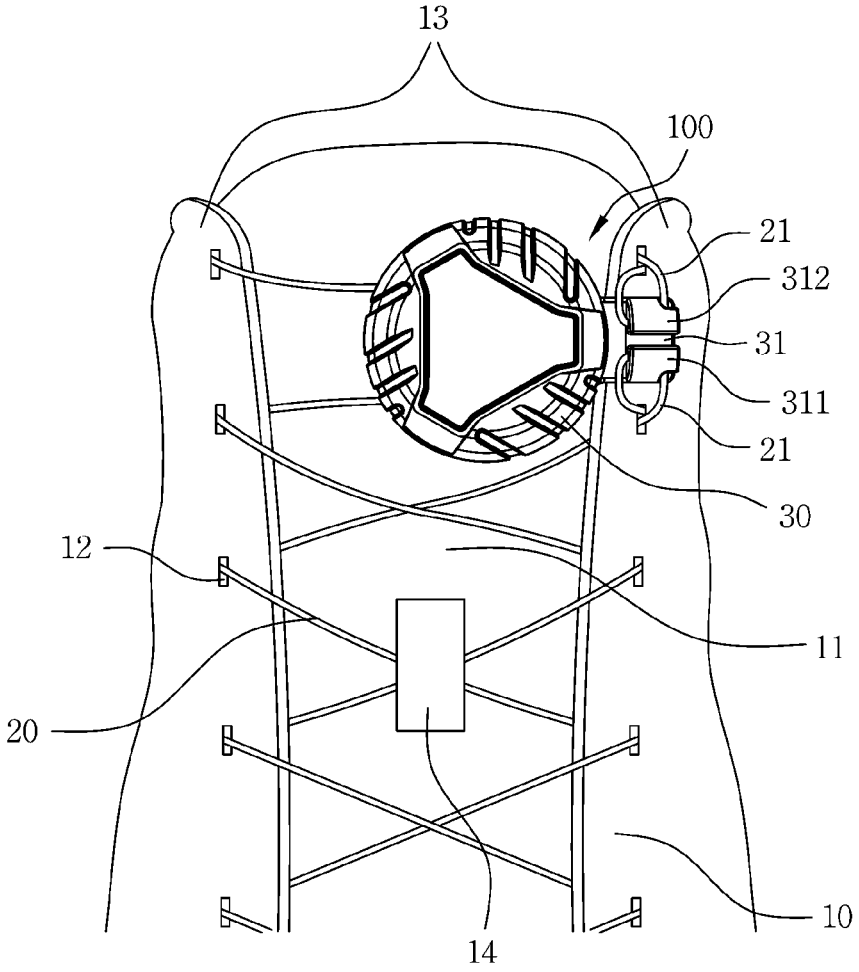
FIG. 1 is a view illustrating the state of attaching a detachable lacing apparatus using a shoelace loop for footwear according to an exemplary embodiment of the present disclosure to a shoe.

Hereinbelow, exemplary embodiments of the present disclosure will be described in detail with reference to the accompanying drawings. Throughout the drawings, the same reference numerals will refer to the same or like parts.

It will be appreciated by a person skilled in the art that the present disclosure can be embodied in other various forms without departing from the spirit or essential characteristics thereof. Embodiments of the present disclosure are therefore considered in all respects to be illustrative, and not restrictive.

Terms such as first and second may be used to describe various components, but the components should not be limited by the terms.

The terms are used only for the purpose of distinguishing one component from another. For example, without departing from the scope of the present disclosure, the first component may be referred to as the second component, and similarly, the second component may also be referred to as the first component.

When a component is referred to as being "connected" or "contacted" to another component, it should be understood that the other component may be directly connected or contacted to the other component, but other components may exist in between.

On the other hand, when it is said that a certain element is "directly connected" or "directly contacted" to another element, it should be understood that no other element is present in the middle.

The terms used in the present application are only used to describe specific embodiments, and are not intended to limit the present disclosure. The singular expression includes the plural expression unless the context clearly dictates otherwise.

In this application, the terms "comprise", "provide", or "have" are intended to indicate that there is a feature, number, step, action, component, part, or combination thereof described on the specification, and it is to be understood that the present disclosure does not exclude the possibility of the presence or the addition of one or more other features, numbers, steps, operations, components, parts, or combinations thereof.

Also, unless otherwise defined, all terms used herein, including technical or scientific terms, have the same meaning as commonly understood by a person skilled in the art.

Terms such as those defined in the commonly used dictionaries should be construed as having meanings consistent with the meanings in the context of the related art and shall not be construed in ideal or excessively formal meanings unless expressly defined in this application.

Hereinafter, in order to describe the present disclosure in sufficient detail that a person skilled in the art could carry it out easily, the most preferred embodiment of the present disclosure will be described in detail with reference to the accompanying drawings.

Figure 2:
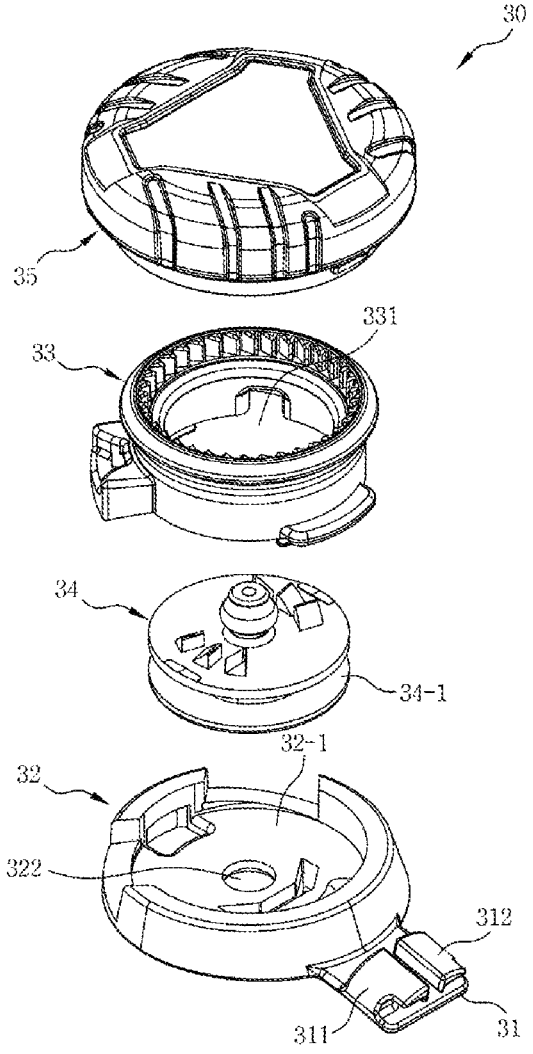
FIG. 2 is an exploded perspective view of a shoelace length adjuster of a detachable lacing apparatus using a shoelace loop for footwear according to an exemplary embodiment of the present disclosure.
Figure 3A:
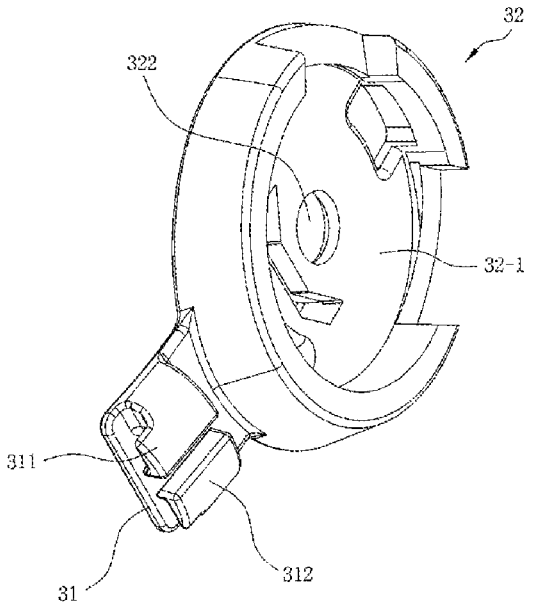
FIGS. 3A and 3B are top and rear perspective views of a detachable housing included in a shoelace length adjuster of a detachable lacing apparatus using a shoelace loop for footwear according to an exemplary embodiment of the present disclosure.
Figure 3B:
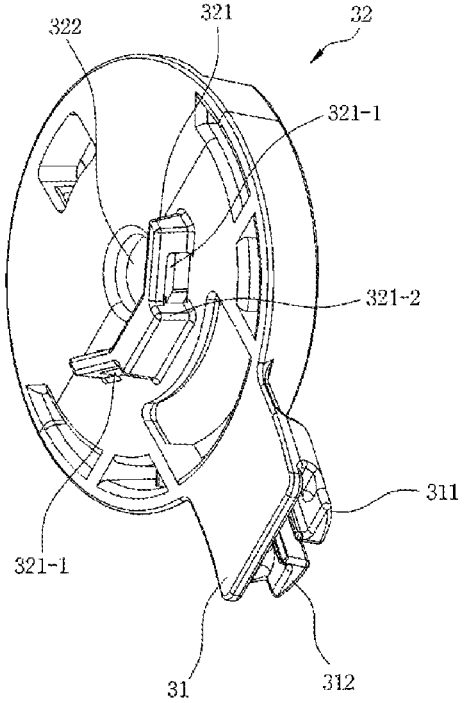
Figure 4A:
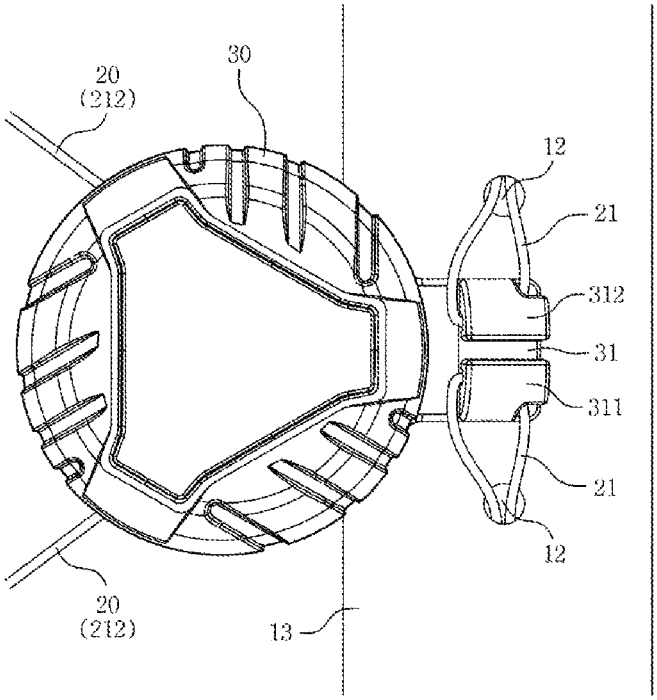
FIGS. 4A and 4B are top and rear perspective views illustrating the mounting state of a shoelace length adjuster of a detachable lacing apparatus using a shoelace loop for footwear according to an exemplary embodiment of the present disclosure.
Figure 4B:
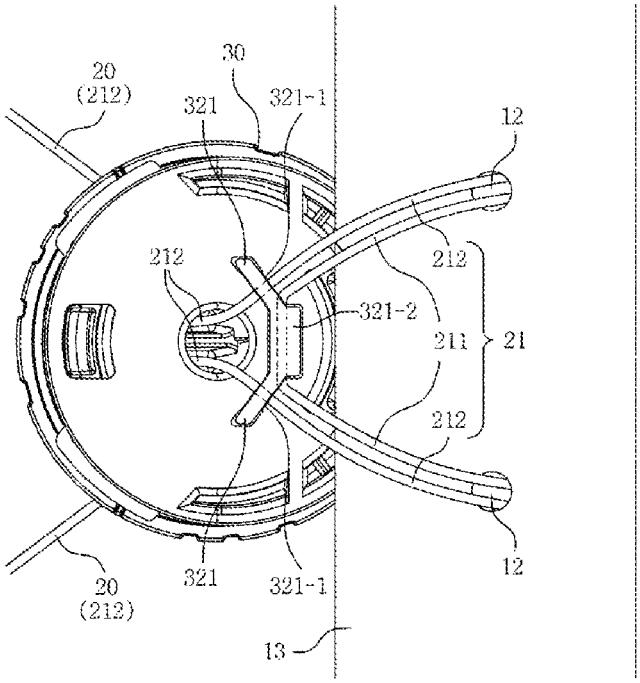

FIG. 1 is a view illustrating the state of attaching a detachable lacing apparatus using a shoelace loop for footwear according to an exemplary embodiment of the present disclosure to a shoe;

FIG. 2 is an exploded perspective view of a shoelace length adjuster of a detachable lacing apparatus using a shoelace loop for footwear according to an exemplary embodiment of the present disclosure;

FIGS. 3A and 3B are top and rear perspective views of a detachable housing included in a shoelace length adjuster of a detachable lacing apparatus using a shoelace loop for footwear according to an exemplary embodiment of the present disclosure; and FIGS. 4A and 4B are top and rear perspective views illustrating the mounting state of a shoelace length adjuster of a detachable lacing apparatus using a shoelace loop for footwear according to an exemplary embodiment of the present disclosure. A detachable lacing apparatus using a shoelace loop for footwear 100 according to an exemplary embodiment has, as shown in the accompanying drawings including FIG. 1, a length adjuster detachable part 31 provided in a shoelace length adjuster 30 that is detachably coupled to a shoelace hole 12 (or a shoe eyelet) side by using a wire that is a shoelace, making it easier to loosen or tighten shoelaces in shoes such as ready-made sneakers manufactured with the shoelace hole 12 or the shoe eyelet (not shown) to bind a shoelace. The apparatus includes a wire 20 that is a shoelace connected through a plurality of shoelace holes 12 formed on a shoe 10, and the shoelace length adjuster 30 provided with the length adjuster detachable part 31 having a locking groove part 311 and 312 in which a shoelace loop 21 passed through the shoelace hole 12 (or the shoe eyelet) is fastened.

As shown in the drawings, it is preferable that the locking groove part 311 and 312 be formed in two facing each other on an upper side of the length adjuster detachable part 31 so as to have two shoelace loops (21; see FIG. 4A) passed through two shoelace holes 12 oppositely fastened.

In the illustrated example, the length adjuster 30 is detachably coupled to the shoelace hole 12 (the shoe eyelet is also possible), however, it is also possible that the shoelace length adjuster 30 be attached and detached by connecting to a lace loop (drawing number not assigned) formed on a shoe tongue (drawing number not assigned).

For reference, a wire to be described below may be a wire, which is a shoelace loop, added to the detachable lacing apparatus using a shoelace loop for footwear 100. However, the scope of the present disclosure does not need to be limited to one type of wire, and although it is collectively referred to as a wire in the claims of the present disclosure, it is natural that various materials and types of wire may be covered. That is, a wire 20, which is a shoelace, may be formed from any of a wide variety of polymeric or metallic materials or combinations thereof that exhibit sufficient axial strength and bendability for the present application. For example, any of a wide variety of solid core wires, solid core polymers, or multi-filament wires or polymers, which may be woven, braided, twisted, or otherwise constructed, may be used. A solid or multi-filament metal core may be provided with a polymeric coating, such as PTFE or others known in the art, in order to reduce friction.

Although the illustrated example shows an example in which the detachable lacing apparatus using a shoelace loop for footwear 100 is provided in a shoe, this may be applied to a fastening device that can be variously used in articles such as clothes, accessories, or exercise equipment, etc. that are worn by tightening a wire or string including hats, belts, gloves, bags, and equipment for water skiing and snowboarding etc.

On the shoe 10, as illustrated in FIG. 1, a tongue 11 is formed up and down in the center, and a plurality of shoelace holes 12 are formed to face each other on the upper and lower left and right sides of the tongue 11, and the wire 20 is connected in a crosswise form.

On the tongue 11, one or a plurality of lace loops 14 are formed, through which the wire 20, connecting a plurality of shoelace holes 12 spaced up and down and facing each other, is connected in a crosswise form. The spacing of the shoelace holes 12 corresponding to each other may be the same, or the spacing may increase from the lower side of the tongue 11 (the portion where the shoe upper and tongue are connected) toward the upper side.

As illustrated in FIG. 1, the length adjuster 30 has the wire 20 wound and connected inside, performs a role of tightening the wire 20 by rotation, and includes on one side the length adjuster detachable part 31 having the locking groove part 311 and 312 in which a shoelace loop 21 passed through two shoelace holes 12 is fastened, and as a result, the shoelace length adjuster 30 may be stably fixed and supported thanks to the tightening of the shoelace loop 21.

As illustrated in the drawings including FIG. 2, it is preferable that the length adjuster detachable part 31, in which the locking groove part 311 and 312 is formed, protrude in a roughly rectangular shape from one side of the roughly cylindrical-shaped detachable housing 32 of the shoelace length adjuster 30, and a pair of the locking groove parts 311 and 312 be formed facing each other on top of the length adjuster detachable part 31.

As illustrated in FIG. 4A, it is preferable that the length adjuster detachable part 31, on top of which the locking groove parts 311 and 312 are formed facing each other, be located, when the shoelace length adjuster 30 is attached to a shoe, between adjacent two shoelace holes 12 (on top of the shoe upper 13) through which two shoelace loops pass.

More specifically, as illustrated in FIG. 2, the shoelace length adjuster 30 is configured to have the detachable housing 32 in which the length adjuster detachable part 31 is formed, a fixed housing 33, a winding drum 34, and a rotation housing 35.

There is no limitation in the type of the length adjuster according to the present disclosure while the above three components are essential to various length adjusters, and in the case of the present disclosure, there is no limitation in the type of the length adjuster while it needs to be understood that a length adjusting apparatus including the essential components is not limited to any length adjuster.

More specifically, as illustrated in FIG. 2, the shoelace length adjuster 30 is configured to have the detachable housing 32, on one side of which the length adjuster detachable part 31 is formed and having a cylindrical-shaped accommodation part 32-1 of which an upper portion is open, the fixed housing 33 seated and fixed in the accommodation part 32-1 and having a vertical opening 331, the winding drum 34 arranged in the opening 331 and having a winding part 34-1 around/from which a wire 20 is wound or unwound, and the rotation housing 35 rotatable with respect to the fixed housing 33 and coupled to be vertically movable in an axial direction with the winding drum 34 as an axis while rotating the winding drum 34.

The detachable housing 32 is roughly cylindrical-shaped and has the accommodation part 32-1, of which an upper portion is open, formed inside to accommodate the fixed housing 33, the winding drum 34, and the rotation housing 35, giving space in which the shoelace length adjuster 30 can operate, while on one side of the detachable housing 32 the length adjuster detachable part 31 is formed in which two shoelace loops (21; see FIG. 4A) passed through two shoelace holes 12 through the pair of locking groove parts 311 and 312 facing each other are oppositely fastened so that the shoelace length adjuster 30 may be fixed to the shoe.

Also, the detachable housing 32, as illustrated in FIGS. 3B and 4B, has on the lower side a shoelace loop bifurcation part 321 formed in which each shoelace loop in two lines (21; see FIG. 4A) fixed by fitting into two opposing locking grooves passes from the upper side to the lower side of the shoe upper through the adjacent two shoelace holes 12 and branches into two first and second lines 211 and 212 respectively so that the two first lines 211 are interconnected and the two second lines 212 are separated and connected to the winding drum 34, and includes a shoelace passing hole 322 formed in the central portion adjacent to the shoelace loop bifurcation part 321 and through which two second lines 212 branched from the shoelace loop bifurcation part 321 pass and are connected to the winding drum 34.

The shoelace loop bifurcation part 321, as illustrated in FIGS. 3B and 4B, has a cross section which is roughly a U shape as a whole, has two shoelace loop passing holes 321-1 opposite to each other so that two shoelace loops 21, passed from the upper side to the lower side of the shoe upper through adjacent two shoelace holes 12, pass through facing each other to branch into first and second lines 211 and 212, and includes a shoelace loop connecting groove 321-2 formed in the shape of a groove between the two shoelace loop passing holes 321-1 so that two first lines 211 of the two branched first and second lines 211 and 212 are interconnected and fixed, and wherein the two separated second lines 212 pass through the shoelace loop passing holes 321-1 respectively and are connected to the winding drum 34 through the shoelace passing hole 322.

The fixed housing 33, as illustrated in FIG. 2, is roughly a cylindrical shape, has a vertical opening 331, and is to be seated in the accommodation part 32-1 of the detachable housing 32.

In the fixed housing 33, a sawtooth (not shown) is formed, which is machined in a shape that allows only one direction rotation of the rotation housing 35 when engaged with a latch (not shown) of the rotation housing 35 to be described later. Since the interlocking structure of the fixed housing and the rotation housing is a well-known technique, a detailed description thereof will be omitted.

The winding drum 34, as illustrated in FIG. 2, includes a winding part 34-1 disposed in the vertical opening 331 of the fixed housing 33 and through which the wire 20 is wound or unwound when the fixed housing 33 is seated in the accommodation part 32-1 of the detachable housing 32.

That is, in the winding part 34-1, the second line, which is two lines (212; see FIG. 4B) separated after passing through two shoelace loop passing holes 321-1, passes through the shoelace passing hole 322 and is oppositely separated as two lines and wound or unwound in the winding part.

The rotation housing 35 which acts as a handle when winding the wire is coupled to the fixed housing 33 to be rotatable or movable upward or downward in the axial direction.

In other words, the rotation housing 35 is rotatable with respect to the fixed housing 33 and coupled to be vertically movable in an axial direction with the winding drum 34 as an axis while rotating the winding drum 34. Since the structure of the rotation housing is also a well-known technique, an additional amplified description will be omitted.

In this way, by having on one side of the shoelace length adjuster 30 the length adjuster detachable part 31 in which the locking groove 311 and 312 is formed in which the ends of two shoelace loops 21 passed through two adjacent shoelace holes are fastened and may be tightened and untightened according to winding and unwinding of the shoelace length adjuster 30, the shoelace length adjuster 30 having a cylindrical shape is easily fixed and attached in a way that sticks firmly to the shoe 10, making it more stable and easier to loosen or tighten shoelaces.

Although the embodiment of the present disclosure has been described in detail above, this is merely a description of one embodiment so that a person skilled in the art to which the present disclosure pertains can easily practice the present disclosure, and the technical spirit of the present disclosure should not be construed as being limited by the description of the embodiment.

What is claimed is:

1. A detachable lacing apparatus using a shoelace loop for footwear, the apparatus comprising:

a shoelace having end parts connected to each other; and a shoelace length adjuster in which the shoelace is wound and connected, and configured to tighten the shoelace by rotation, wherein the shoelace is configured to pass through a plurality of shoelace holes or shoe eyelets formed on the footwear, wherein the shoelace length adjuster is fixed by the shoelace loop passed through the shoelace holes or the shoe eyelets, wherein the shoelace length adjuster comprises:

a length adjuster detachable part to which the shoelace loop is fixed, wherein the length adjuster detachable part is provided with a locking groove part in which the shoelace loop is fastened;

a detachable housing having therein a cylindrical-shaped accommodation part, of which an upper portion is open;

a fixed housing seated and fixed in the accommodation part of the detachable housing and having a vertical opening;

a winding drum arranged in the opening and having a winding part configured to allow the shoelace to be wound or unwound therearound or therefrom; and a rotation housing configured to be rotatable with respect to the fixed housing and coupled thereto to be vertically movable in an axial direction with the winding drum as an axis while rotating the winding drum, wherein the locking groove part is formed in two parts facing each other on an upper side of the length adjuster detachable part so as to allow two parts of the shoelace loop passed through adjacent two shoelace holes to be oppositely fastened thereto, wherein the length adjuster detachable part is formed by protruding from one side of the detachable housing, wherein the detachable housing comprises:

a shoelace loop bifurcation part formed on a lower side of the detachable housing and in which each part of the shoelace loop fastened in the two parts of the locking groove part, which passes through a shoe upper through the adjacent two shoelace holes, branches into first and second lines so that the first lines of the two part of the shoelace loop are interconnected and the second lines of the two part of the shoelace loop are separated and connected to the winding drum; and a shoelace passing hole formed in a central portion adjacent to the shoelace loop bifurcation part, and through which the second lines branched from the shoelace loop bifurcation part pass and are connected to the winding drum.

2. The detachable lacing apparatus for footwear of claim 1, wherein when the shoelace length adjuster is attached, the length adjuster detachable part is located between the adjacent two shoelace holes through which the two parts of the shoelace loop pass.

3. The detachable lacing apparatus for footwear of claim 1, wherein the shoelace loop bifurcation part comprises:

two shoelace loop passing holes opposite to each other for allowing the two parts of the shoelace loop, passed through a shoe upper through the adjacent two shoelace holes, to pass therethrough while facing each other and to branch into the first and second lines; and a shoelace loop connecting groove formed between the two shoelace loop passing holes opposite to each other and through which the first lines of the two part of the shoelace loop are interconnected together, wherein the second lines of the two part of the shoelace loop are separated from each other through the two shoelace loop passing holes and connected to the winding part of the winding drum through the shoelace passing hole.

4. The detachable lacing apparatus for footwear of claim 3, wherein the second lines of the two part of the shoelace loop connected to the winding drum are separated facing each other in the winding part to be wound or unwound.

* * * * *